US011325226B2

(12) United States Patent
Shih

(10) Patent No.: US 11,325,226 B2
(45) Date of Patent: May 10, 2022

(54) UNIDIRECTIONAL RATCHET WRENCH STRUCTURE

(71) Applicant: ZHEJIANG MAXTOP TOOLS MANUFACTURE CO., LTD, Zhejiang (CH)

(72) Inventor: Neng-Chia Shih, Changhua County (TW)

(73) Assignee: ZHEJIANG MAXTOP TOOLS MANUFACTURE CO., LTD, Zhejiang (CN)

( * ) Notice: Subject to any disclaimer, the term of this patent is extended or adjusted under 35 U.S.C. 154(b) by 0 days.

(21) Appl. No.: 16/932,805

(22) Filed: Jul. 19, 2020

(65) Prior Publication Data

US 2022/0016749 A1 Jan. 20, 2022

(51) Int. Cl.
*B25B 13/46* (2006.01)

(52) U.S. Cl.
CPC ..... *B25B 13/463* (2013.01)

(58) Field of Classification Search
CPC ..... B25B 13/463; B25B 13/46; B25B 13/461; B25B 13/462
USPC ..... 81/60–63.2
See application file for complete search history.

(56) References Cited

U.S. PATENT DOCUMENTS

| | | | | |
|---|---|---|---|---|
| 7,444,903 | B1 | 11/2008 | Li | |
| 8,291,792 | B2 * | 10/2012 | Yang | B25B 13/463 81/63.2 |
| 9,016,174 | B2 * | 4/2015 | Lee | B25B 13/461 81/62 |
| 9,120,211 | B2 * | 9/2015 | Huang | B25B 13/463 |
| 9,757,844 | B2 * | 9/2017 | Chen | B25B 13/463 |
| 9,862,076 | B2 * | 1/2018 | Lai | B25B 13/462 |

* cited by examiner

*Primary Examiner* — David B. Thomas

(57) ABSTRACT

A unidirectional ratchet wrench structure has a wrench member, a pawl and a ratchet. The wrench member has an accepting space for accommodating the ratchet and an accepting space for accommodating the pawl. A toothed section of the pawl has a plurality of equiangular teeth and an irregular tooth. Since the irregular tooth is lower than the height of the equiangular teeth, the irregular teeth irregular tooth is capable of quickly disengaging from the equiangular teeth of the ratchet. The arc section and the toothed section have different arc measures and not push against the outer periphery of the ratchet at the same time, through the abutment of the pivoting point and the change of the center of gravity of the pawl when the wrench is rotated, the pawl is capable of producing a seesaw yaw movement to achieves the effect of quick engagement and disengagement.

5 Claims, 9 Drawing Sheets

UNIDIRECTIONAL RATCHET WRENCH STRUCTURE

BACKGROUND of INVENTION

Field of Invention

The present invention relates to a hand tool, and more particularly to a unidirectional ratchet wrench structure.

Description of Related Art

A conventional ratchet wrench, as in U.S. Pat. No. 7,444,903B1, Taiwan application publication No. M327769: a ratchet wrench has a wrench body, a ratchet wheel, a pawl member and an elastic member. The wrench body having an end portion provided with a mounting hole and a receiving chamber connected to the mounting hole. The ratchet wheel mounted in the mounting hole of the wrench body and having an outer wall provided with a plurality of ratchet teeth. The pawl member defining a top surface and a bottom surface mounted in the receiving chamber of the wrench body having a first side including a first end provided with a plurality of locking teeth extending from the top surface to the bottom surface engaged with the ratchet teeth of the ratchet wheel successively and completely and a second end provided with a sliding face extending from the top surface to the bottom surface slidable on the ratchet teeth of the ratchet wheel, said first and second ends defining a whole circumferential length of the first side of the pawl member. The elastic member mounted in the receiving chamber of the wrench body and biased between a peripheral wall of the receiving chamber of the wrench body and a second side of the pawl member to push the pawl member toward the ratchet wheel. The elastic member is located adjacent to the sliding face of the pawl member and the sliding face of the pawl member is located between the elastic member and the locking teeth of the pawl member. The first side of the pawl member is a concave surface which extends through the whole circumferential length of the first side of the pawl member. The sliding face of the pawl member is a concave recessed smooth surface which extends successively and completely through a circumferential length of the second end of the first side of the pawl member that is half of the circumferential length of the first side of the pawl member. The pawl member is movable relative to the ratchet wheel between a first position where all of the locking teeth of the pawl member are engaged with the ratchet teeth of the ratchet wheel closely and completely, and the sliding face of the pawl member evades the ratchet teeth of the ratchet wheel, and a second position where all of the locking teeth of the pawl member are disengaged from the ratchet teeth of the ratchet wheel, and the sliding face of the pawl member is movable on the ratchet teeth of the ratchet wheel.

However, the above-mentioned conventional structure still has some shortcomings. The main reasons are as follows: the inner arc recess of the pawl member is filled with ratchets and the inner arc is concave. The other side section is provided with a low and flat sliding surface. Because the teeth angles of the pawl member are equal and the teeth of the outer periphery of the ratchet are engaged, when the pawl member and the ratchet want to separate and form an idling, the pawl member needs to be pushed for a longer stroke, which increases the friction time with the ratchets and cannot be quickly detached, thereby causing damage to the wear of the teeth of the pawl member. In addition, the tooth and sliding surfaces of the pawl member simultaneously engage and push against the teeth on the outer periphery of the ratchet, and the spring is arranged at the central bottom of the pawl member facing the central position of the accepting groove, so that when the structure is used, the pawl member disengages or engages with the ratchet in a straight up and down manner, which greatly reduces the engage efficiency of the pawl member and the ratchet and causes collision between ratchet teeth.

Therefore, it is desirable to provide a unidirectional ratchet wrench structure to mitigate and/or obviate the aforementioned problems.

SUMMARY of INVENTION

An objective of present invention is to provide a unidirectional ratchet wrench structure, which is capable of improving the above-mention problems.

In order to achieve the above mentioned objective, a unidirectional ratchet wrench structure has a wrench member, a pawl and a ratchet. The wrench member has an accepting space for accommodating the ratchet and an accepting space for accommodating the pawl. A toothed section of the pawl has a plurality of equiangular teeth and an irregular tooth. Since the irregular tooth is lower than the height of the equiangular teeth, the irregular teeth irregular tooth is capable of quickly disengaging from the equiangular teeth of the ratchet. The arc section and the toothed section have different arc measures and not push against the outer periphery of the ratchet at the same time, through the abutment of the pivoting point and the change of the center of gravity of the pawl when the wrench is rotated, the pawl is capable of producing a seesaw yaw movement to achieves the effect of quick engagement and disengagement.

Other objects, advantages, and novel features of invention will become more apparent from the following detailed description when taken in conjunction with the accompanying drawings.

DETAILED DESCRIPTION OF PREFERRED EMBODIMENT

Figure 1:
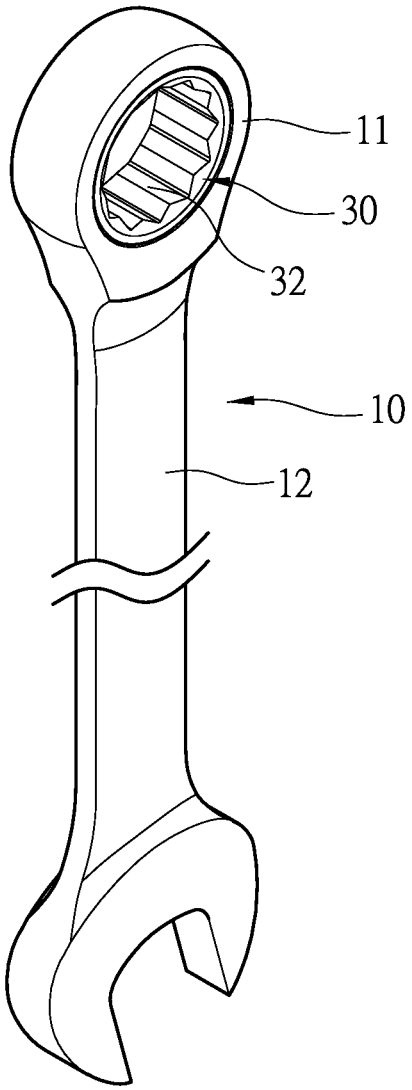
FIG. 1 is a perspective view of a preferred embodiment according to the present invention.
Figure 2:
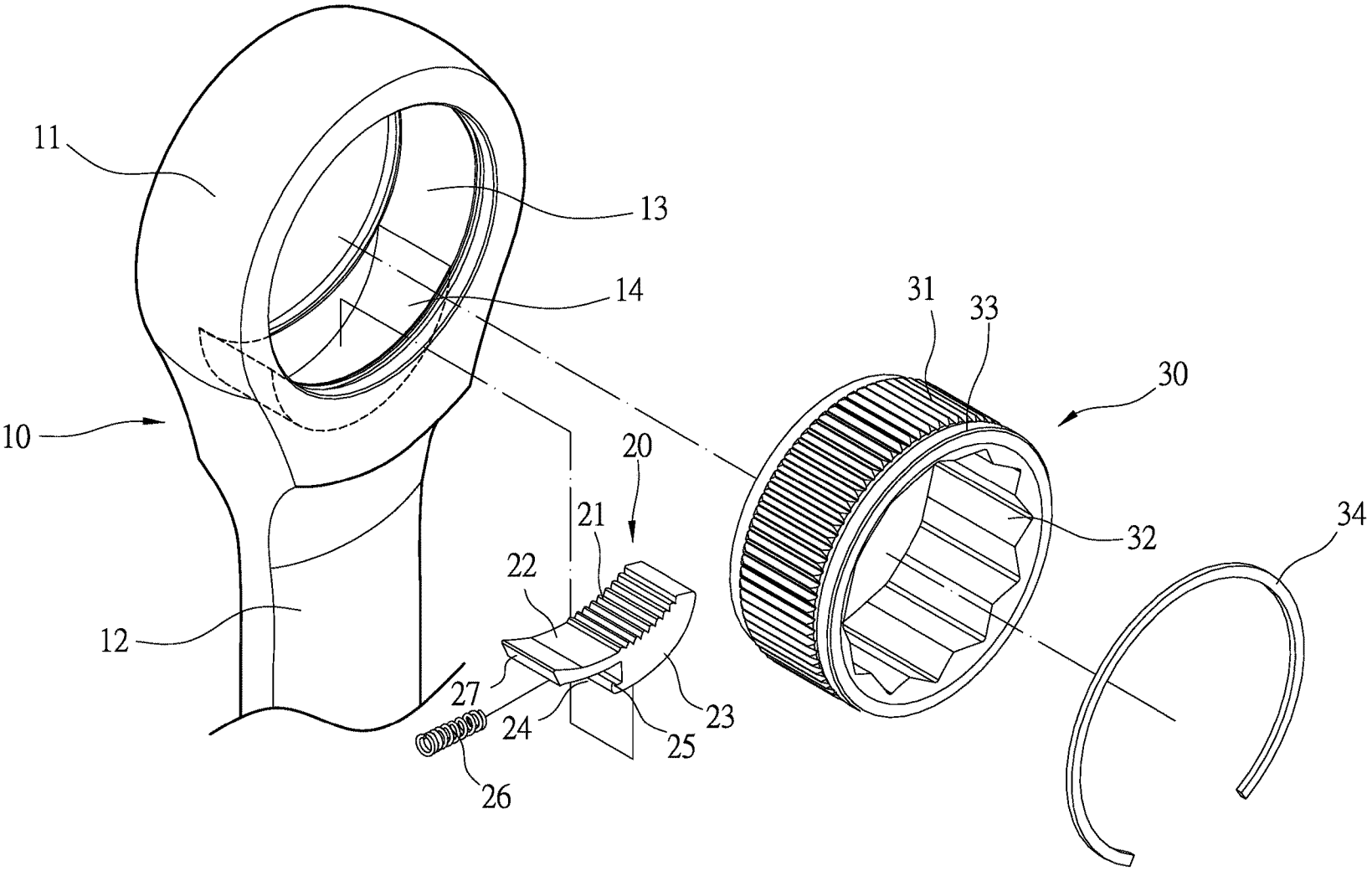
FIG. 2 is an exploded view of the preferred embodiment according to the present invention.
Figure 3:
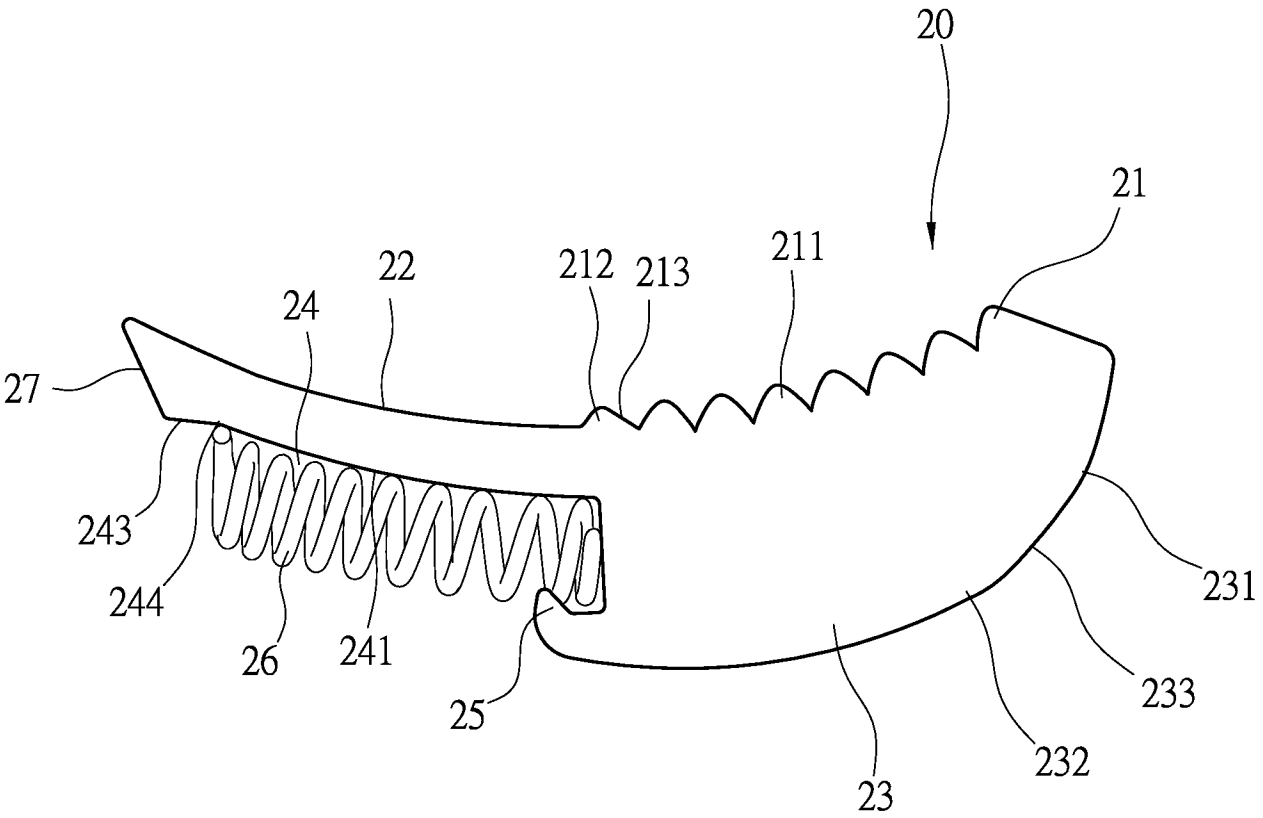
FIG. 3 is an enlarged schematic view of the pawl of the preferred embodiment according to the present invention.

First, please refer to FIGS. 1, 2 and 3. A unidirectional ratchet wrench structure comprises: a wrench member 10, a pawl 20 and a ratchet 30. The wrench member 10 has a head portion 11 and a handle portion 12. The head portion 11 comprises an accepting space 13 connected to an accepting groove 14 positioned toward the handle portion 12, and the accepting groove 14 has an arc shape. The pawl 20 is accepted in the accepting groove 14. The pawl 20 has a concave upper surface facing the accepting space 13 and comprises a toothed section 21 and an arc section 22. The toothed section 21 has a plurality of equiangular teeth 211 and an irregular tooth 212 adjacent to the arc section 22. An addendum angle of the irregular tooth 212 is greater than an addendum angle of the equiangular teeth 211, and there is a 10-20° difference between them. In addition, an addendum height of the irregular tooth 211 is lower than an addendum height of the equiangular teeth 211 which provides an escaping space 213. An arc measure of the arc section 22 and an arc measure of the toothed section 21 are unequal, and the arc section 22 is lower than the toothed section 21. A lower surface of the pawl 20 comprises a resting curve 23 and an accommodating notch 24, and the resting curve 23 has at least one first portion 231 and one second portion 232 and a pivoting point 233 between the first and second portions 231, 232. The arc measures of the first and second portions 231, 232 of the resting curve 23 are different, and an arc length of the first portion 231 is less than an arc length of the second portion 232. The resting curve 23 has a hook end 25 facing toward the accommodating notch 24 securing a spring 26 in the accommodating notch 24. An upper surface of the accommodating notch 24 comprises an upper arc 241 and an extended surface 243, a stopping wall 242 extends from upper arc 241, and a limiting cavity 244 is formed between the extended surface 243 and the upper arc 241 and configured for positioning another end of the spring 26. Furthermore, an original length of the spring 26 is equal to a length of the upper arc 241 and an end of the extended surface 243 is less than an end of the arc section 22 and the two ends are connected to form a beveled end 27. The ratchet 30 has a plurality of equiangular teeth 31, a brake slot 32 and an engaging slot 33 at one end. A C-shaped fastener 34 secures the ratchet 30 in the accepting space 13, and the equiangular teeth 31 of the ratchet 30 engage with the toothed section 21 of the pawl 20.

For the assembly of the structure, please refer to FIGS. 1 to 4 again. The accepting groove 14 of the wrench member 10 accommodates the pawl 20, and the ratchet 30 is installed in the accepting space 13 and the C-shaped fastener 34 is employed for limiting the ratchet 30 in the accepting space 13. The resting curve 23 of the pawl 20 is facing the bottom of the accepting groove 14 and the pivoting point 233 between the first and second portion 231 and 232 pushed against the bottom of the accepting groove 14. The spring 26 of the pawl 20 in the accommodating notch 24 pushes against the other end of the accepting groove 14, and the spring 26 is restricted between the hook 25 and the limiting cavity 244. Meanwhile, the spring 26 provides an elastic force to push the toothed section 21 of the pawl 20 towards the accepting space 13, and then the toothed section 21 engages with the equiangular teeth 31 on the periphery of the ratchet 30. Since the end of the toothed section 21 has an irregular tooth 212, and the irregular tooth 212 is lower than the other equiangular teeth 211, so that the irregular tooth 212 and the equiangular teeth 31 do not fully engage. Furthermore, the irregular tooth 213 and the equiangular teeth 31 define the escaping space 213, the arc section 22 of the pawl 20 is lower than the toothed section 21, when the toothed section 21 engages with the equiangular teeth 31 of the ratchet 30, the arc section 22 is away from the equiangular teeth 31 to form a yaw gap 221.

Figure 4:
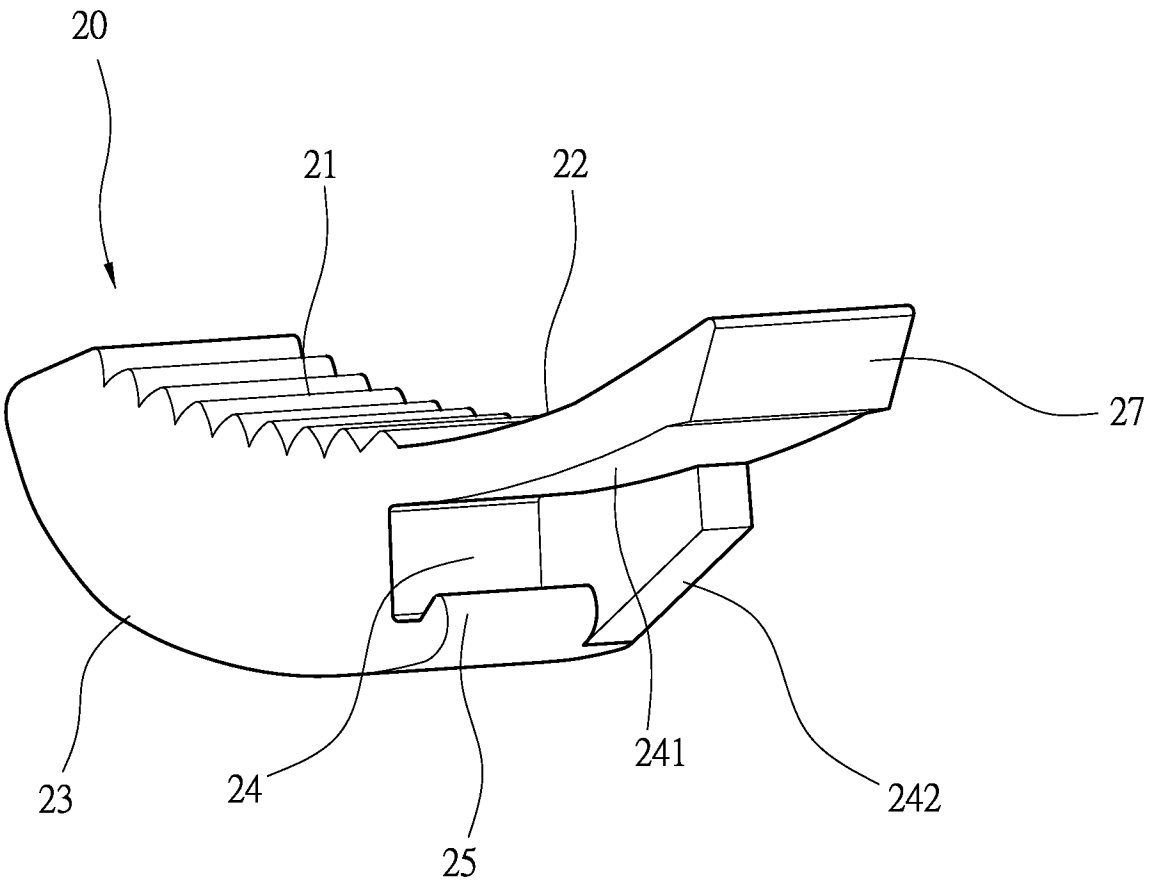
FIG. 4 is a partially enlarged perspective view of another aspect of the pawl of the preferred embodiment according to the present invention.
Figure 5:
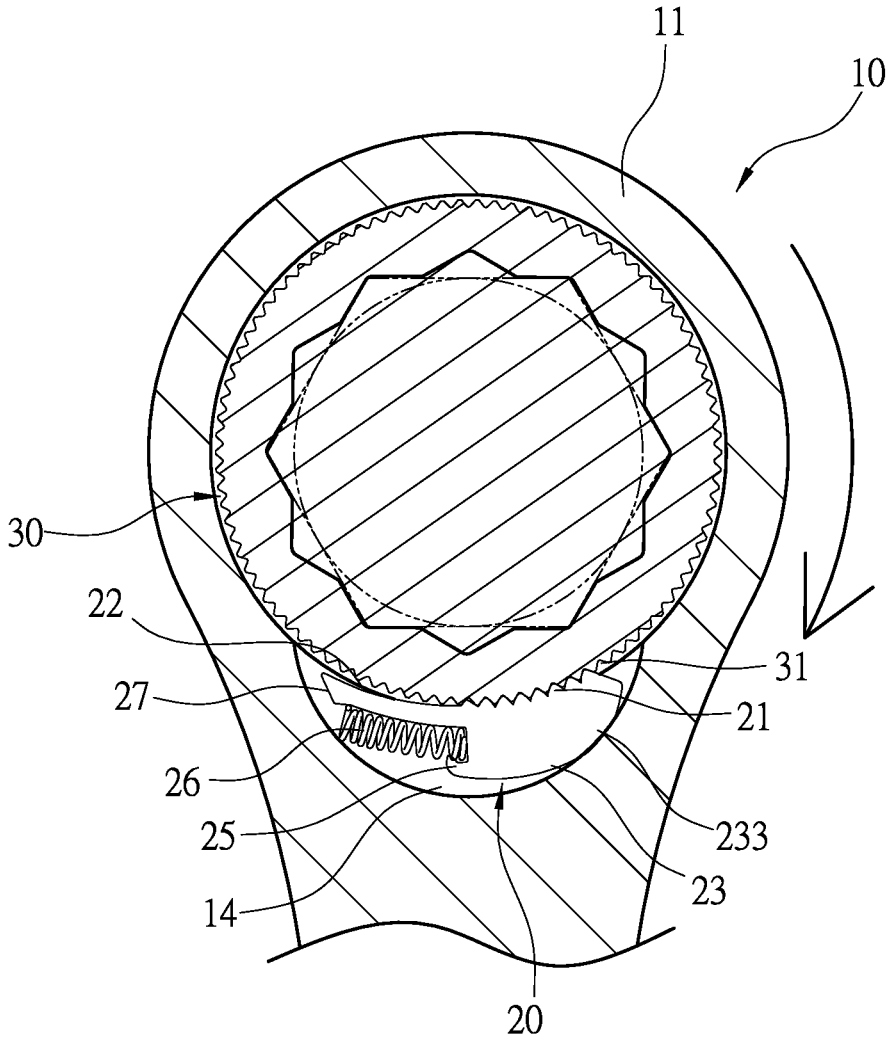
FIG. 5 is a cross-sectional view of the preferred embodiment according to the present invention during clockwise rotation.

For the actual use of the structure, please refer to FIGS. 4 and 5. The wrench member 10 engages with a workpiece nut with the ratchet 30 of the head portion 11 and the handle portion 12 applies torque to the workpiece nut for locking or unscrewing operation. When a user holds the wrench member 10 and rotates it in a clockwise direction to tighten the workpiece nut, the ratchet 30 produces a counter-clockwise rotating reaction force. Since the spring 26 is located opposite than the clockwise rotation side of the pawl 20, when the ratchet 30 rotates counterclockwise, the pawl 20 is pushed upward by the spring 26 and the toothed section 21 engages with the equiangular teeth 31 on the outer periphery of the ratchet 30, and the pivoting point 233 of the resting curve 23 pushes against the inner side wall of the accepting groove 14, so that the ratchet 30 engages with the pawl 20, and the ratchet 30 is able to tighten the workpiece nut with the wrench member 10 clockwise rotation.

Figure 6:
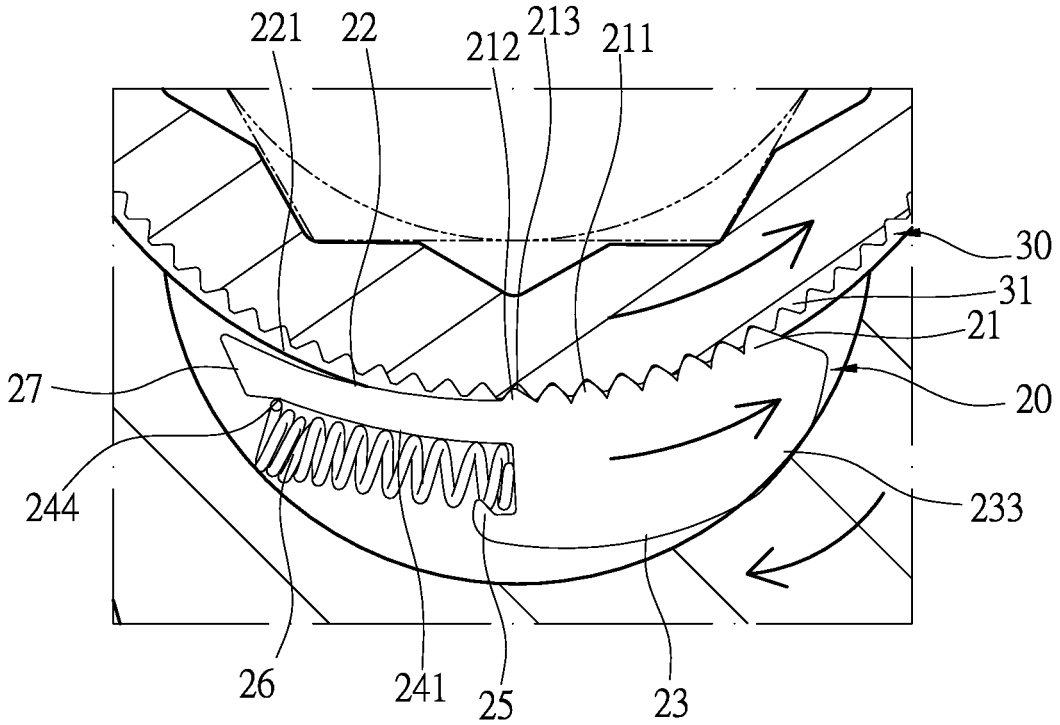
FIG. 6 is a partially enlarged schematic view of the wrench member of the preferred embodiment according to the present invention during clockwise rotation.
Figure 7:
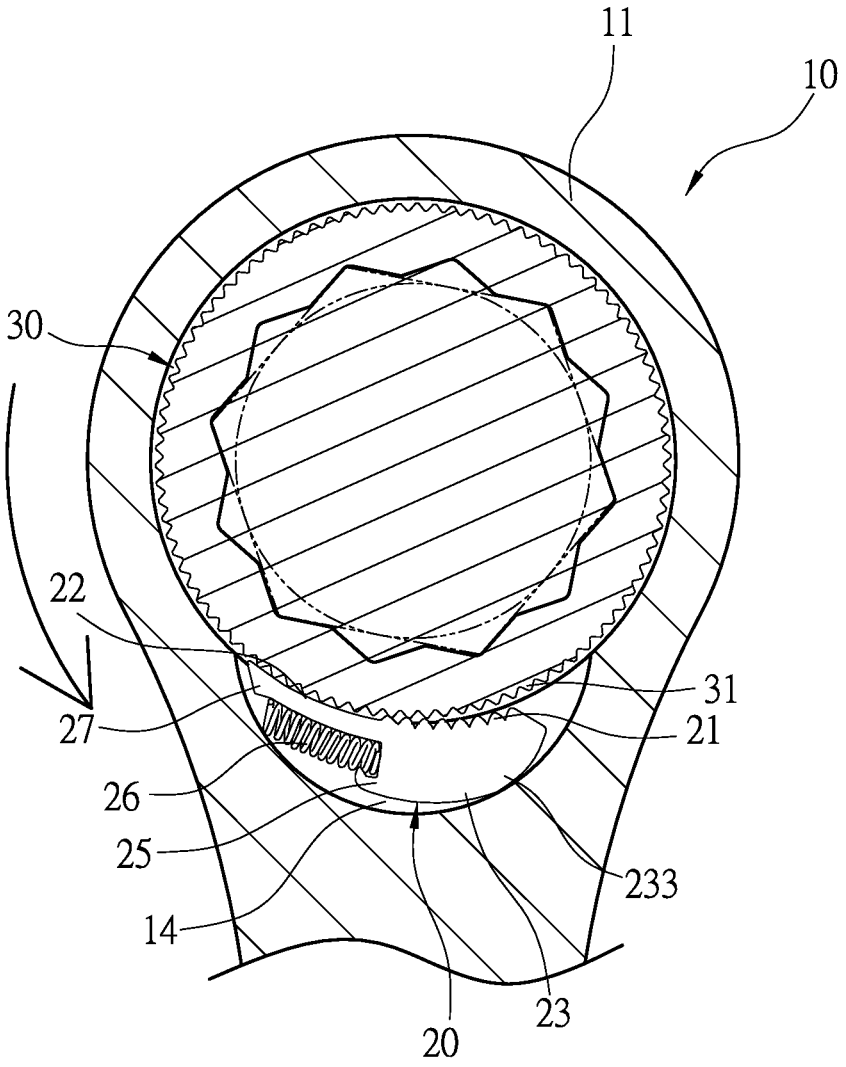
FIG. 7 is a schematic view of the wrench member of the preferred embodiment according to the preferred embodiment according to the present invention.
Figure 8:
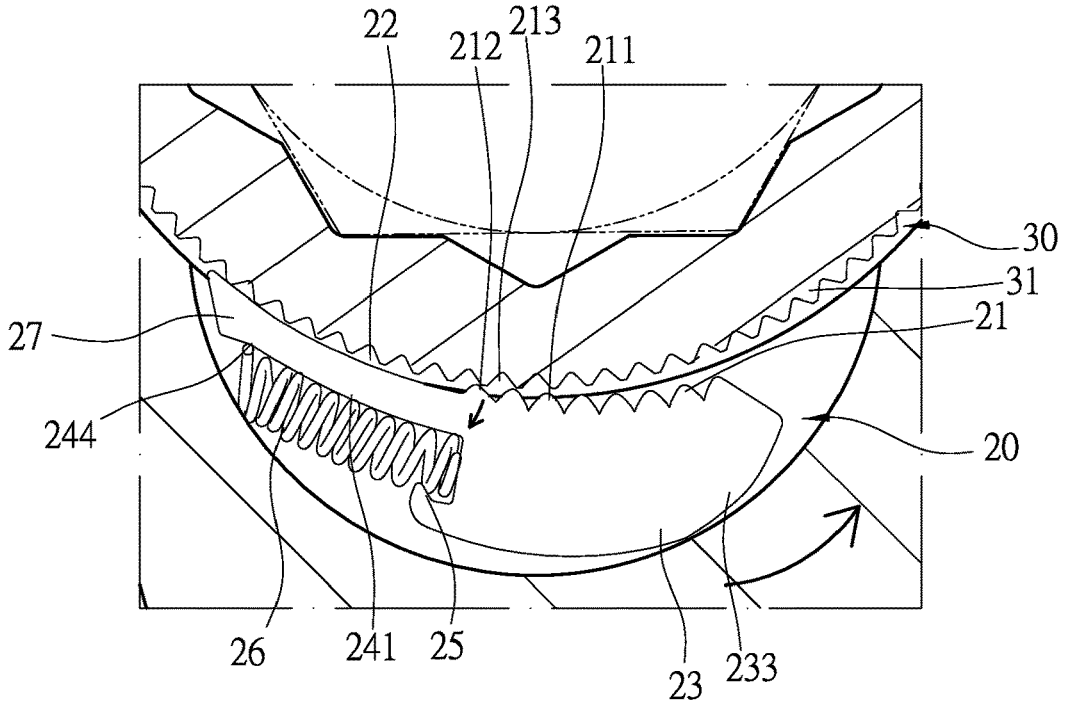
FIG. 8 is a partially enlarged schematic view of the wrench member of the preferred embodiment according to the present invention during counterclockwise rotation.

On the contrary, when the wrench member 10 is rotated counterclockwise, as shown in FIGS. 6, 7, and 8, the ratchet 30 is placed and positioned on the workpiece nut and produces a reaction force of clockwise rotation, and the pawl 20 is driven to rotates clockwise and compress the spring 26. Meanwhile, the pawl 20 first quickly release from the equiangular teeth 31 of the ratchet 30 via the escaping space 213 on the irregular teeth 212, so the equiangular teeth 31 lowers to change the center of gravity of the pawl 20 and the arc section 22 to abut the equiangular teeth 31 of the ratchet 30, and then the toothed section 21 completely separates from the equiangular teeth 31 of the ratchet 30 as the non-engagement state of the pawl 20 and the ratchet 30. Therefore, that the ratchet 30 idles in the accepting space 13 which retracts the handle portion 11 of the wrench member 10, and then the handle member 12 of the wrench member 10 is capable of a clockwise rotation locking operation.

Figure 9:
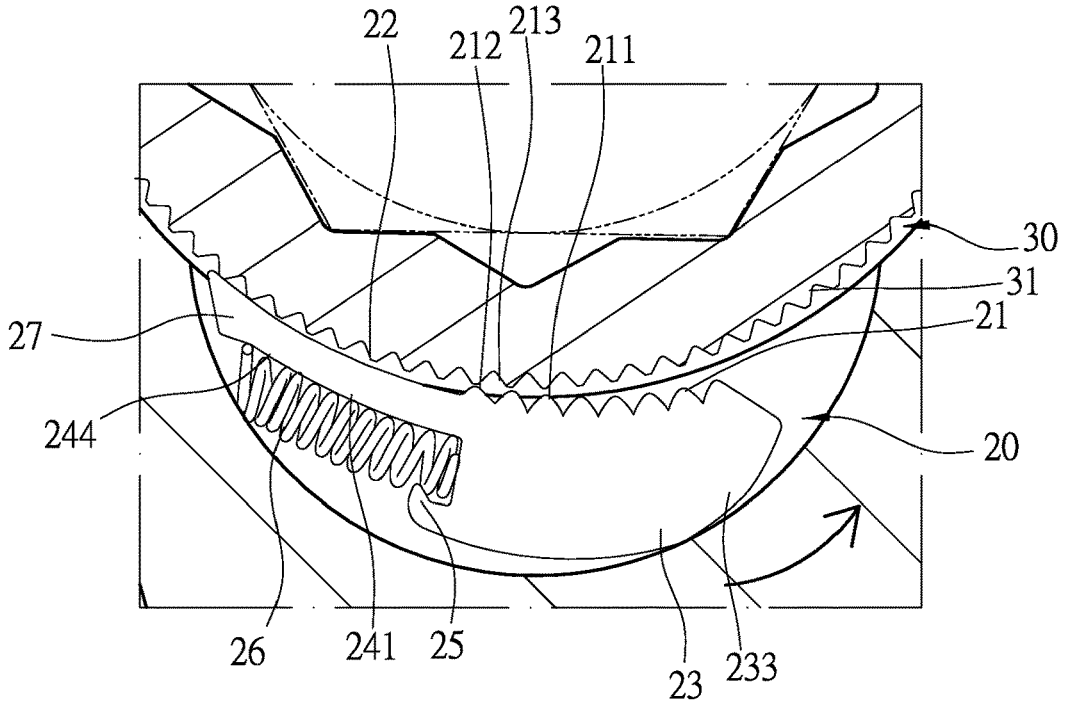
FIG. 9 is a partially enlarged schematic view of the wrench member of the present invention during counterclockwise rotation and disengagement.
Figure 10:
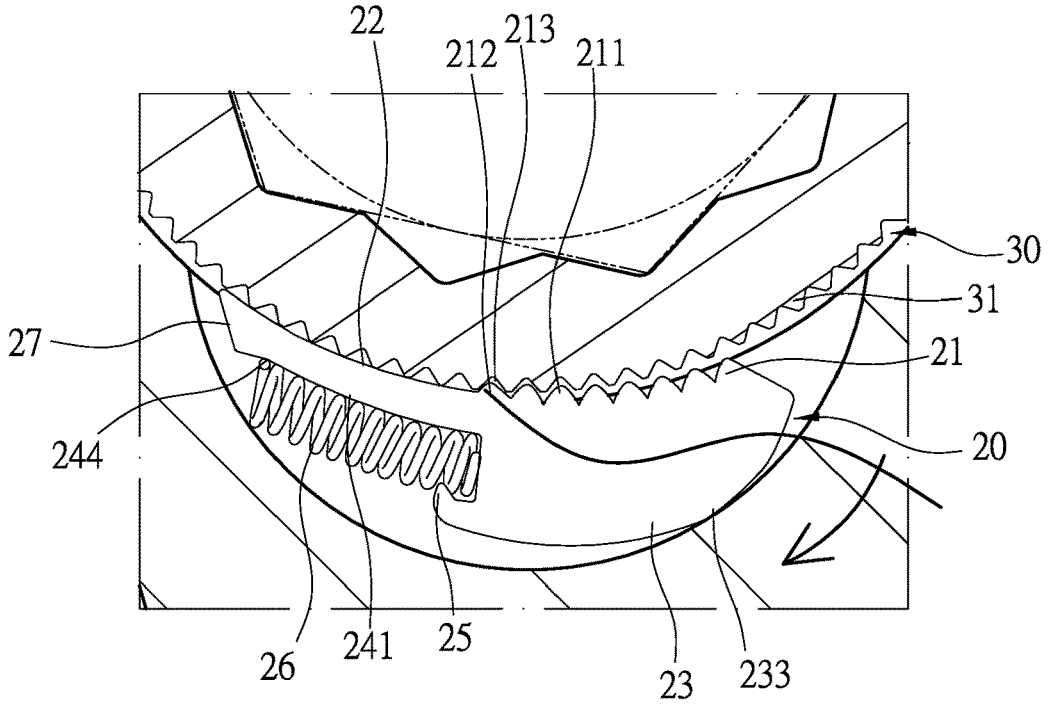
FIG. 10 is a partially enlarged schematic view of the wrench member of the present invention during the clockwise rotation again.
Figure 11:
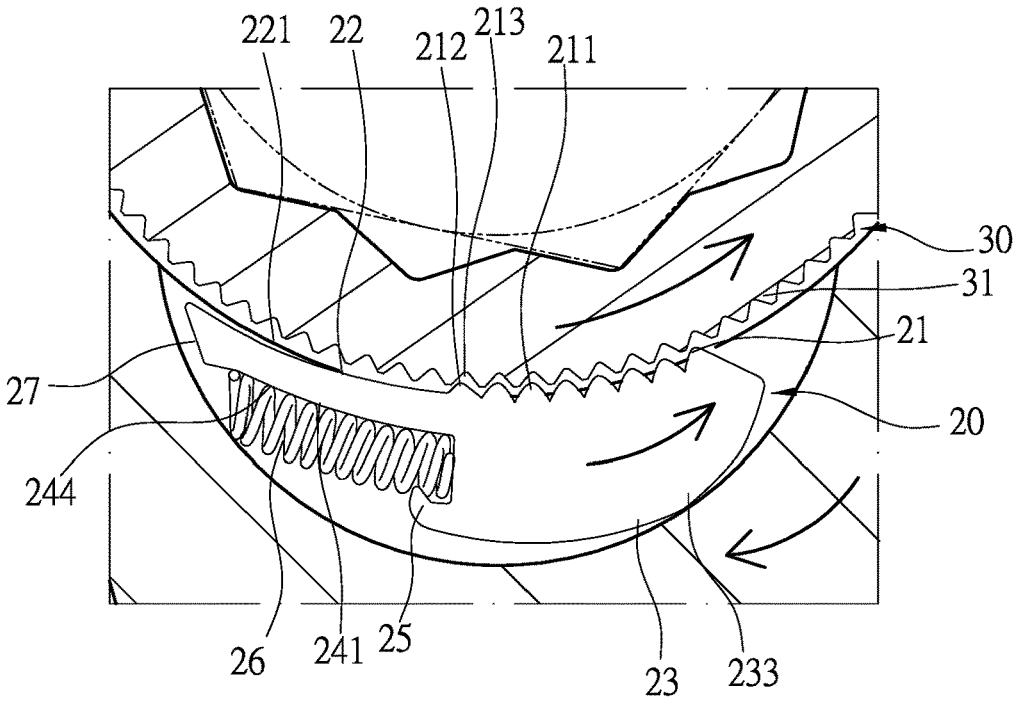
FIG. 11 is a partially enlarged schematic view of the wrench member of the present invention during the clockwise rotation and engaged again.

Furthermore, when the wrench member 10 is reversed and then rotated clockwise to apply force, as shown in FIGS. 9 and 10, the ratchet 30 produce a counterclockwise rotating reaction force to make the pawl 20 loses the clockwise rotation force and allow the spring 26 to retract and reset, and then the pawl 20 pushes counterclockwise and the pivoting point 233 pushes against the bottom surface of the accepting groove 14. Afterward, the pivoting point 233 is used as the center of gravity so that the arc section 22 leans up against the equiangular teeth 31 of the ratchet 30, such that the counterclockwise reaction force generated by the ratchet 30 preferentially pushes the irregular teeth 212 and to rotate the pawl 20 counter-clockwise. Therefore, the arc section 22 of the pawl 20 separates from the equiangular teeth 31, while the toothed section 21 fully engages with the equiangular teeth 31 of the ratchet 30, so that the ratchet 30 can rotate clockwise with the wrench member 10 to tighten the workpiece nut.

In addition, when the pawl 20 compresses the spring 26 clockwise due to the wrench member 10 rotates counter-clockwise, the arc section 22 of the pawl 20 again leans against the equiangular teeth 31, thereby reducing the space between the pawl 20 and the inner wall of bevel 27 and the accepting groove 14, and since the limiting cavity 244 indeed abut against the end of the spring 26, the spring 26 is truly limited in the accommodating notch 24 which effectively avoids the spring 26 form slipping out.

With the structure of the above specific embodiment, the following benefits can be obtained: the toothed section 21 of the pawl 20 has an irregular tooth 212 adjacent to the arc section 22, since the angle of the irregular tooth 212 is different than the equiangular teeth 211 and the irregular tooth 212 is lower than the height of the equiangular teeth 211, when the wrench member 10 is rotated counterclockwise, the irregular teeth irregular tooth 212 is capable of quickly disengaging from the equiangular teeth 31 of the ratchet 30. Moreover, the arc section 22 and the toothed section 21 have different arc measures and not push against the outer periphery of the ratchet 30 at the same time, through the abutment of the pivoting point 233 and the change of the center of gravity of the pawl 20 when the wrench is rotated, the pawl 20 is capable of producing a seesaw yaw movement to achieves the effect of quick engagement and disengagement, which helps to improve the practicality of the ratchet wrench.

Although the present invention has been explained in relation to its preferred embodiment, it is to be understood that many other possible modifications and variations can be made without departing from the spirit and scope of invention as hereinafter claimed.

What is claimed is:

1. A unidirectional ratchet wrench structure comprising:

a wrench member having a head portion and a handle portion, the head portion comprising an accepting space connected to an accepting groove positioned toward the handle portion, the accepting groove having an arc shape; and a pawl accepted in the accepting groove, the pawl having a concave upper surface facing the accepting space and comprising a toothed section and an arc section, the toothed section having a plurality of equiangular teeth and an irregular tooth adjacent to the arc section, an addendum angle of the irregular tooth being greater than an addendum angle of the equiangular teeth, and an addendum height of the irregular tooth being lower than an addendum height of the equiangular teeth and providing an escaping space; an arc measure of the arc section and an arc measure of the toothed section being unequal, and the arc section being lower than the toothed section, a lower surface of the pawl comprising a resting curve and an accommodating notch, the resting curve having at least one first portion and one second portion and a pivoting point between the first and second portions, the resting curve having a hook end facing toward the accommodating notch securing a first end of a spring in the accommodating notch, an upper surface of the accommodating notch comprising an upper arc and an extended surface, a limiting cavity formed between the extended surface and the upper arc and configured for positioning a second end of the spring, the second end of the spring configured to push against the accepting groove to provide an elastic force to the pawl via the first end of the spring, an end of the extended surface being shorter than an end of the arc section and the two ends being connected to form a beveled end; and a ratchet having a plurality of equiangular teeth, a brake slot and an engaging slot at one end, a C-shaped fastener securing the ratchet in the accepting space, the equiangular teeth of the ratchet engaging with the toothed section of the pawl.

2. The unidirectional ratchet wrench structure as claimed in claim 1, wherein there is a 10-20° difference between an addendum angle of the irregular tooth and an addendum angle of the equiangular teeth.

3. The unidirectional ratchet wrench structure as claimed in claim 1, wherein an arc measure of the first and second portions of the resting curve are different, and the first portion is less than the second portion.

4. The unidirectional ratchet wrench structure as claimed in claim 1, wherein an unbiased length of the spring is equal to a length of the upper arc.

5. The unidirectional ratchet wrench structure as claimed in claim 1, wherein one side of the accommodating notch of the pawl has a stopping wall under the upper arc.

* * * * *